United States Patent [19]

Byers

[11] 3,982,238

[45] Sept. 21, 1976

[54] TIME BASED MONITORING SYSTEM

[76] Inventor: William L. Byers, Glidden St., Newcastle, Maine 04553

[22] Filed: Aug. 22, 1974

[21] Appl. No.: 499,399

[52] U.S. Cl. ..... 340/279; 340/309.1

[51] Int. Cl.[2] ..... G08B 21/00

[58] Field of Search ..... 340/279, 306, 213 R, 340/309.1; 235/92 PK, 92 PE; 128/25, DIG. 29; 200/DIG. 35

[56] References Cited

UNITED STATES PATENTS 3,115,622 12/1963 Jaffe ..... 340/258 B

*Primary Examiner*—Donald J. Yusko
*Assistant Examiner*—William M. Wannisky
*Attorney, Agent, or Firm*—Russell & Nields

[57] ABSTRACT

A monitoring system for the notification of locations external to the area being monitored of a prolonged absence of motion within the area being monitored is disclosed consisting of a clock, an electronic counter designed to record the pulses emitted periodically by the clock and to signal an alarm trigger when a pre-programmed number of pulses are recorded, and reset means such that if activated the counter will return to zero thereby preventing activation of the alarm trigger. Also, this system uses circuit means incorporating a photoelectric cell to automatically increase the pre-programmed number of pulses necessary to cause activation of the alarm trigger during periods of darkness and to automatically return the counter to its original pre-programmed condition with the presence of light.

9 Claims, 1 Drawing Figure

TIME BASED MONITORING SYSTEM

BACKGROUND OF THE INVENTION

1. Field of the Invention

This invention involves an activity monitoring system for the protection of individuals who either work or live alone. Its purpose is not, however, to monitor particular activities, nor is it designed to ensure the performance of any particular duties, whether of a sequential nature or not.

The purpose of the present invention is to provide an automatic alarm to neighbors, police, ambulance, or some other source of readily available aid in the event that the mobility of a person (particularly the elderly) is impaired by accident or illness to the extent that that person is unable to summon the necessary aid himself. Thus, the present system senses only the presence or absence of activity. The particular nature thereof is immaterial to the purpose and operation of this system.

SUMMARY OF PRIOR ART

2. In the past, and even today, numerous accidents and deaths have occurred which were not discovered for days or even weeks. Whatever the reason for this is, whether it be apathy, fear, the break down of close family ties, distance, or some other, it is clear that in a fair percentage of these cases the victim may not have died from the debilitating accident or illness itself, but from exposure, malnutrition and a lack of common first aid. Early discovery in such a case could well save a victim's life.

The present invention thus removes the factor of lack of discovery from the equation, but significantly provides this result in such a way that the person being monitored does not need to alter his daily routine and need not feel he is being "watched". Both of these factors are important. Using daily routine to indicate the "protected condition" gives the system a certain, almost inherent, reliability, and the fact that the unit is internal to the monitored area unless and until the alarm unit is activated lends a certain privacy to the system absent in central protection agency systems which constantly monitor the output, usually "protected" and "non-protected" signals, at a point totally external and possibly very distant from the monitored area. The present system, therefore, allows the individual psychological freedom from the feeling of being watched while at the same time providing an alarn to those closest at hand should an emergency arise.

SUMMARY OF THE INVENTION

Summarily stated then the basic theory and practice of the present invention is as follows. Starting from the premise that in most cases some sort of mobility is present in persons using this device, it is clear that such a person could perform a function as part of another act or directed exclusively to the performance of that function.

Thus, the present invention contemplates a system connected by appropriate circuitry incorporating a free running time base, i.e. a clock made to outpulse into a counter system having a reset capability and an output adjustable in accord with a preselected pulse count. That is the counter will emit a signal to an alarm trigger and thence to an alarm device only after a predetermined number of pulses are recorded in the counter. For instance, if the time base outpulses into the counter once an hour, the counter might be set to trigger the alarm sequence after it records the fourth count (pulse), i.e. after 4 hours. If, however, at some point prior to the recording of the fourth count, the reset mechanism is activated, the counter and clock return to zero (start of sequence) and the signal to the alarm trigger is delayed until the pre-set count is recorded, i.e. until 4 hours after reset. It is therefore possible to continually delay the activation of the alarm sequence.

The reset mechanism is contemplated to be anything from a simple push-button or switching mat to a more sophisticated motion detector. In any case, the circuitry is designed such that any one of several possible such reset switches will, if activated, reset the entire system. Thus, if for example several switching mats are used as reset switches, the simple location of such devices under the rugs in the most used dwelling travel paths allows the reset function to be accomplished as part of the routine movement about the dwelling.

The basic system of the present invention also contemplates a circuit closure to turn on the alarm. The alarm itself may however be anything from a simple flashing light in a window to a more sophisticated telephone device for direct dialing to concerned persons.

Further, the present invention comprehends a light sensitive device connected to the counter such that the counter output signal will be given upon the preselected number of counts being recorded under lighted conditions, but such output will be suppressed under conditions of darkness for a second preselected number of counts (typically ten). This automatically allows for periods of sleep.

BRIEF DESCRIPTION OF THE DRAWING

These features and the operation of the exemplary embodiment herein described will be seen more clearly in the following detailed description of the drawing in which.

DESCRIPTION OF THE PREFERRED EMBODIMENT

Figure 1:
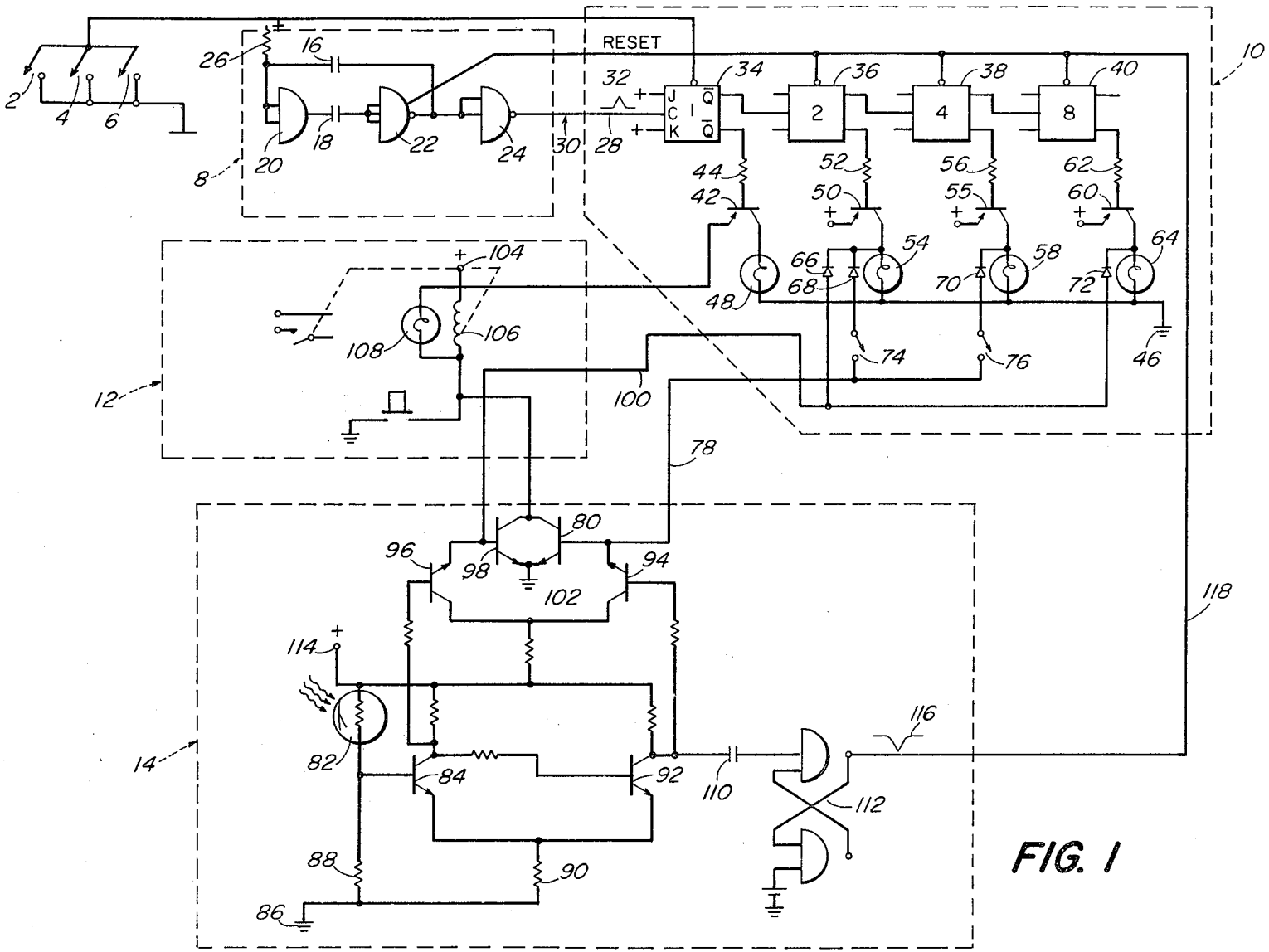
FIG. 1 is a complete logic diagram of a circuit suitable for use in the present invention.

In FIG. 1 elements 2, 4, and 6 are representative reset switches designed such that activation of any one will reset the electronic counter and thereby delay the alarm. FIG. 1 also provides the basic outline of the present system and is a convenient basis for this description of the operation and typical manner of use thereof.

The switches 2, 4, and 6 are representative of a plurality of such switches placed throughout the dwelling or work area to be monitored. By way of example and not limitation, this description will focus upon a dwelling wherein switching mats are placed under rugs in the most used travel paths. The remainder of the system is located at some central point, for example inconspicuously near the bed and telephone.

In operation the central unit is connected to an external power source (not shown), and may also be connected to an emergency battery pack (also not shown) which would come into use should normal electrical power be discontinued for some reason. The clock indicated at 8 outpulses to the electronic counter indicated at 10 at fixed intervals and the counter records these pulses as counts. The counter itself is programmed to outpulse to an alarm trigger and thence to an alarm (both indicated at 12) should a preselected number of counts (pulses) be recorded, the light sensitive device indicated at 14 being designed to increase the number of pulses (counts) before alarm during periods of darkness and to return the system to the original present interval when lighted conditions return. Thus, a typical day's use might follow the following pattern if the preset number of counts was four and the constant interval between pulses was 1 hour.

Lighted conditions having commenced at say 6 A.M., the system automatically starts a four hour sequence. The individual arises at say 9 A.M. and steps on a switching mat in the upstairs hall in walking from his bedroom to the bath, thereby resetting the system. Thereafter the system starts a second sequence. The daily routine thus proceeds, but prior to 1 P.M. the individual will have reset the system again, say, by activating a switch under the kitchen floor at lunch time. This starts a third sequence and prior to 5 P.M. the system is reset again by either one of the two switches already mentioned or others located say in the downstairs hall, on the stairs, in the living room, etc. Again, by 9 P.M. the system will have been reset. If the individual retires say at 11 P.M. the light sensitive device senses darkness and lengthens the period (number of counts until alarm) accordingly to allow for sleep.

If for some reason the reset function was not accomplished during the day within 4 hours from the previous reset, appropriate alarm measures would automatically have been taken. Thus, even if nothing was seriously wrong, concerned neighbors, etc. could quickly check on the monitored individual thereby easing the minds of all concerned and avoiding the phenomenon of lack of discovery which has arisen in today's selfcentered society.

Obviously, the system contemplates that the monitored individual will always be within the monitored area at least at some time during each sequence. If for some reason that is not the case, the unit may be either shut off or a manually-operable circuit similar to the light sensitive device added.

In detail then, the constant interval free running time base of this embodiment indicated at 8 comprises a "clock" which is illustrated in the drawing as a single bi-stable Flip-Flop having an output of one pulse per hour. The flip-flop is diagrammatically shown as two inverters 20, 22 cross-coupled by condensers 16, 18. The output from this flip-flop is inverted by the inverter 24. In actual practice the flip-flop delivering the output pulse at one pulse per hour might be the last of a series of flip-flops connected as a divider chain to which an output series of trigger pulses is delivered from a stable oscillator operating at some higher frequency. For example, a series of 12 flip-flops connected to the trigger input of its successor in the series would provide an output frequency of $\frac{1}{2}^{12}$ or 1/4096 that of the input frequency. In this way a digital input of the order of one negative-going pulse per second would result in a digital output of the order of one negative-going pulse per hour. The digital input could be provided by a suitable pulse generator driven by a frequency-stable oscillator. The negative-going pulse per hour is converted to a positive-going pulse per hour by the inverter 24.

If it is preferable for cost, convenience, or some other reason, a mechanical device may be substituted with minor changes in the counter connections without adverse operational effect for the typical electronic pulse generator here described. In either case, however, care must be taken to "debounce" the interface indicated at 30 between the clock and the counter in order to prevent "phantom" pulse creation which could adversely effect the operation of the counter.

The counter accepts the positive pulses 32 transmitted along line 28 from the clock in a plurality of common logic elements 34, 35, 38, and 40 connected in series, and uses them to step the logic circuits as follows. The first pulse is accepted at the "C" terminal of logic element 34 (the "J" and "K" terminals are held positive in all circuits) and this drives the "Q" terminals negative. This in turn allows a bias to be applied to the base of transistor 42 through resistor 44 so that a sufficiently amplified signal passes to ground 46 to activate lamp 48. The second pulse is accepted at the C terminal of logic element 34 but this time drives the Q terminals positive. The C terminal of logic element 36 is thus positively pulsed driving its Q terminals negative thereby biasing the base of transistor 50 through resistor 52 and passing an amplified signal to ground 46 lighting lamp 54.

The third pulse is again accepted at terminal C of logic element 34. In this case the Q terminals go negative, the lamp 48 again lights, but logic element 36 receives no positive input so that is no further effect.

The fourth pulse however drives the Q terminals of logic element 34 positive which in turn supplies the C terminal of logic element 36 with positive input thereby driving its Q terminals positive. This in turn drives logic element 38 with positive input causing its Q terminals to go negative biasing the base of transistor 55 through resistor 56 thereby causing an amplified signal to ground 46 lighting lamp 58.

It can easily be seen therefore that the counter described here will provide usable outputs after 1, 2, 4, 8, etc. counts (i.e. after 8 pulses the base of transistor 60 is biased negatively through resistor 62 passing an amplified signal to ground 46 lighting lamp 64).

Diodes 66, 68, 70, and 72 are set in the output lines associated with logic elements 36, 38, and 40 in a blocking configuration so that the resistance associated with lamps 54, 58, and 64 will maintain diodes 66, 68, 70, and 72 in the "ON" state until the amplified output signal from the associated logic element back biases the circuit sufficiently to cause an "OFF" condition to occur in the diodes. Thus, programming switches 74 and 76 allow the alarm trigger indicated at 12, contemplated to be either a bi-stable or a standard relay, to be activated after 2 or 4 counts, and because of the orientation of the diodes 68 and 70, closing both switches 74 and 76 delays output until the sixth pulse since after two pulses current will still pass into the circuitry associated with logic element 38 through diode 70 and a similar result occurs after four pulses with current being directed into the circuitry associated with logic element 36 through diode 68. It is only at the sixth pulse that logic elements 36 and 38 will both have Q terminals in the negative state effectively shutting down diodes 68 and 70 causing a bias signal to be allowed to switch on transistor 80 which triggers the alarm relay.

The clock and counter are also resettable by means of reset switches 2, 4, and 6 which activate "one shot" type circuits contained in logic elements 34, 36, 38, and 40 through terminals at the top of each, and reset flip-flops 22 and 23 through line 25 to their original condition.

Further, the operation of the counter described above provides the user with constant assurance the system is operational through the visual display provided by lamps 48, 54, 58, and 64, and is fail safe in that while there are no means provided in the present embodiment for the prevention of intentional attempts to circumvent it, the system as described above will always be set to yield an alarm, either in accord with preset programming or immediately, should all programming to in the OFF position (a feature which also provides a convenient means for testing the system). Suitable means to prevent tampering with the input (i.e. reset) circuitry could be applied and is considered to be prior art.

Still further, the counter program may have two states according to whether conditions of light or darkness are present. The circuitry indicated at 14 depicts a well-known exemplary circuit (commonly called a Schmitt trigger) for this purpose. During lighted conditions the photocell 82 is in the ON state which decreases its resistance. The base of transisitor 84 is positively biased and therefore turned ON, bringing its collector to near ground and assuring turn OFF of transistor 92. With transistor 92 turned OFF, transistor 94 will be turned ON via series resistors and transistor 94 will attempt to turn ON transistor 80; however, transistor 80 can only be turned ON when selected diodes 68 and 70 are switched out of the circuit or reversed biased by the counter section turning ON their associated lamps 54 and 56.

There is no output along line 100 during lighted periods because transistor 96 is OFF. It might be noted here again that in this embodiment the lamps serve a double purpose, that of indicators and that of bias circuitry.

When current ceases to flow to ground along line 78 due to the back biasing of the diodes, a positive bias via transistor 94 is applied to the base of transistor 80, turning it ON. This in turn increases the total current flow through transistor 80 to ground 102 from the +V source 104 of the alarm trigger through the coil 106 and activates coil 106 of the latching alarm relay and its associated lamp 108.

During periods of darkness on the other hand, the photocell 82 is in the OFF state which effectively increases its resistance and reverses the states of the transistors. Thus, the base of transistor 84 is negatively biased, shutting it OFF, which in turn allows positive bias to be applied to transistor 96, which in turn attempts to bias transistor 98 ON, and operates as above, with the exception that a 10 hour interval is required to meet alarm conditions.

Also associated with this circuit is capacitor 110 and mono-stable flip-flop 112. THe capacitor 110 charges from the +V source 114, and is discharged at each change from light to dark and vice-versa due to the effect of the switching of photocell state. This positive discharge passes through mono-stable flip-flop 112 and emerges as negative pulse 116 which serves as an automatic reset signal to the clock and logic elements along line 118 at each change of state.

It is understood that the embodiment of the present invention herein described is intended to be illustrative and exemplary and not limiting. It will be apparent to one skilled in the art that derivations may be made to adapt the present invention to particular circumstances and parameters and that such adaptions may be made without departing from the spirit of the present invention, which is defined in the following claims.

I claim:

1. A monitoring system for the notification of locations external to the monitored area of a prelonged absence of normal human ambulatory mobility within the monitored area, comprising in combination a resettable clock adapted to give a continuing sequence of electrical pulses at known time intervals, a counter adapted to count said pulses and to give an output signal when the number of pulses counted reaches a predetermined number; one or more reset switches directly responsive to normal human ambulatory mobility adapted to directly reset said clock and counter; said reset switches being located in geographic locations independent of the person of the monitored individual; said geographic locations being so chosen that the reset switches will not function in the absence of normal human ambulatory mobility; and an alarm responsive to said output signal.

2. The monitoring system of claim 1 wherein said clock is a pulse generator and wherein suitable circuit means to debounce the interface switch are located in series between the clock and the counter.

3. The monitoring system of claim 1 wherein the interval between pulses generated by said clock is constant and typically 1 hour.

4. The monitoring system of claim 1 having means to select the number of counts prior to output.

5. The monitoring system of claim 1 wherein there are a plurality of reset switches any one of which will reset the clock and counter.

6. The monitoring system of claim 1 wherein said electronic counter is provided with visual display means showing its operation.

7. The monitoring system of claim 6 wherein said reset switches are switching mats.

8. The monitoring system of claim 5 wherein said reset switches are motion sensing devices.

9. The monitoring system of claim 1 having light responsive circuit means electrically connected to the counter outputs as a supplementary preselector to suppress the output to the alarm during a given number of pulses beyond the predetermined number thereof during periods of darkness.

* * * * *

UNITED STATES PATENT OFFICE

CERTIFICATE OF CORRECTION

Patent No. 3,982,238 Dated September 21, 1976

Inventor(s) William L. Byers

It is certified that error appears in the above-identified patent and that said Letters Patent are hereby corrected as shown below:

In column 1, line 49, "watched" should be --"watched"--
In column 3, line 5, "present" should be --preset--
In column 4, line 1, "clock" should be --"clock"--
In column 4, line 5, "clock" should be --"clock"--
In column 4, line 14, "C" should be --"C"--
In column 4, line 15, "Q" should be --"Q"--
In column 4, line 17, "Q" should be --"Q"--
In column 4, line 21, "C" should be --"C"--
In column 4, line 22, "Q" should be --"Q"--
In column 4, line 24, "that" should be --there--
In column 4, line 25, "Q" should be --"Q"--
In column 4, line 26, "C" should be --"C"--
In column 4, line 28, "Q" should be --"Q"--
In column 4, line 29, "Q" should be --"Q"--
In column 4, line 56, "Q" should be --"Q"--
In column 4, line 59, "on" should be --"on"--
In column 5, line 7, "to" should be --be--
In column 5, line 7, "OFF" should be --"OFF"--
In column 5, line 17, "ON" should be --"ON"--
In column 5, line 19, "ON" should be --"ON"--
In column 5, line 21, "OFF" should be --"OFF"--
In column 5, line 22, "ON" should be --"ON"--
In column 5, line 23, "ON" should be --"ON"--
In column 5, line 24, "ON" should be --"ON"--

UNITED STATES PATENT OFFICE

CERTIFICATE OF CORRECTION

Patent No. 3,982,238 Dated September 21, 1976

Inventor(s) William L. Byers

It is certified that error appears in the above-identified patent and that said Letters Patent are hereby corrected as shown below:

In column 5, line 26, "ON" should be --"ON"--
In column 5, line 29, "OFF" should be --"OFF"--
In column 5, line 36, "ON" should be --"ON"--
In column 5, line 42, "OFF" should be --"OFF"--
In column 5, line 45, "OFF" should be --"OFF"--
In column 5, line 47, "ON" should be --"ON"--
In column 5, line 51, "THe" should be --The--

In claim 7, column 6, line 45, "6" should be --5--

Signed and Sealed this

Eighteenth Day of January 1977

[SEAL]

*Attest:*

RUTH C. MASON
*Attesting Officer*

C. MARSHALL DANN
*Commissioner of Patents and Trademarks*